US011437178B2

(12) United States Patent
Araki

(10) Patent No.: US 11,437,178 B2
(45) Date of Patent: Sep. 6, 2022

(54) COIL COMPONENT

(71) Applicant: Murata Manufacturing Co., Ltd., Kyoto-fu (JP)

(72) Inventor: Kenichi Araki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 559 days.

(21) Appl. No.: 16/655,534

(22) Filed: Oct. 17, 2019

(65) Prior Publication Data

US 2020/0051733 A1 Feb. 13, 2020

Related U.S. Application Data

(62) Division of application No. 15/258,492, filed on Sep. 7, 2016, now Pat. No. 10,490,335.

(30) Foreign Application Priority Data

Sep. 14, 2015 (JP) ..... 2015-181144

(51) Int. Cl.

| | |
|---|---|
| ***H01F 27/28*** | (2006.01) |
| ***H01F 41/00*** | (2006.01) |
| ***H01F 41/02*** | (2006.01) |
| ***H01F 27/255*** | (2006.01) |
| *H01F 27/29* | (2006.01) |

(52) U.S. Cl.

CPC ..... *H01F 27/28* (2013.01); *H01F 27/255* (2013.01); *H01F 41/005* (2013.01); *H01F 41/0246* (2013.01); *H01F 27/29* (2013.01)

(58) Field of Classification Search

None

See application file for complete search history.

(56) References Cited

U.S. PATENT DOCUMENTS

| | | | | |
|---|---|---|---|---|
| 2001/0038327 | A1 | 11/2001 | Aoki et al. | |
| 2003/0112116 | A1 | 6/2003 | Fujimoto et al. | |
| 2006/0255897 | A1 | 11/2006 | Tanaka et al. | |
| 2008/0130258 | A1 | 6/2008 | Kudo et al. | |
| 2009/0015362 | A1* | 1/2009 | Okada | H02J 50/10 336/65 |

(Continued)

FOREIGN PATENT DOCUMENTS

| | | | |
|---|---|---|---|
| CN | 1318852 | A | 10/2001 |
| JP | S52-079225 | A | 7/1977 |
| JP | H05-275238 | A | 10/1993 |

(Continued)

OTHER PUBLICATIONS

An Office Action; "Notification of Reasons for Refusal," mailed by the Japanese Patent Office dated May 15, 2018, which corresponds to Japanese Patent Application No. 2015-181144 and is related to U.S. Appl. No. 15/258,492; with English translation.

(Continued)

*Primary Examiner* — Mandy C Louie

(74) *Attorney, Agent, or Firm* — Studebaker & Brackett PC

(57) ABSTRACT

A coil component including: a magnetic body containing a magnetic material and a resin; a coil buried in the magnetic body; and a pair of outer electrodes electrically connected to the coil. One or more side faces of the magnetic body have a groove, and the groove contains a silicone resin.

1 Claim, 1 Drawing Sheet

(56) References Cited

U.S. PATENT DOCUMENTS

2014/0132387 A1 5/2014 Shin

FOREIGN PATENT DOCUMENTS

| | | | |
|---|---|---|---|
| JP | H08-167538 | A | 6/1996 |
| JP | 2007-048951 | A | 2/2007 |
| JP | 2008-091034 | A | 4/2008 |
| JP | 2009-290034 | A | 12/2009 |
| JP | 2011-003761 | A | 1/2011 |
| JP | 2013-089688 | A | 5/2013 |
| JP | 2014-236112 | A | 12/2014 |
| WO | 2006/073029 | A1 | 7/2006 |

OTHER PUBLICATIONS

An Office Action mailed by the Japanese Patent Office dated Oct. 2, 2018, which corresponds to Japanese Patent Application No. 2015-181144 and is related to U.S. Appl. No. 15/258,492; with English translation.

Notification of the First Office Action issued by the State Intellectual Property Office of the People's Republic of China dated Mar. 2, 2018, which corresponds to Chinese Patent Application No. 201610822149.7 and is related to U.S. Appl. No. 15/258,492; with English translation.

* cited by examiner

COIL COMPONENT

CROSS REFERENCE TO RELATED APPLICATIONS

This application claims benefit of priority to Japanese Patent Application 2015-181144 filed Sep. 14, 2015, the entire content of which is incorporated herein by reference.

TECHNICAL FIELD

The present disclosure relates to a coil component. Specifically, the present disclosure relates to a coil component that includes a magnetic body and a coil buried in the magnetic body.

BACKGROUND

As electronic devices have become high-performance and downsized in recent years, electronic components for use in the electronic devices have been also required to be smaller. Coil components such as inductors are no exception and have also been downsized by various design modifications.

For example, known coil components have been produced by inserting a metal core into the space inside a coil and then burying this coil and the core into a magnetic body by press molding. However, this method cannot reduce the "side gap", which is a gap between the outer periphery of the coil and the side faces of the magnetic body, and thus cannot downsize the coil component. One way to solve this problem and downsize the component is, for example, a sheet press method disclosed in Japanese Unexamined Patent Application Publication No. 2011-3761. The sheet press method includes: sandwiching a plurality of coils between two magnetic sheets and pressure-bonding these coils and sheets; and dividing this into chips with a dicer.

The inventor of the present disclosure noticed that, in the case where a coil component (e.g., an inductor) is produced by the above-described sheet press method, the resulting inductor may have a groove in its side faces between the top and bottom magnetic sheets because of the coil sandwiched between the magnetic sheets.

The base body obtained by the sheet press method (that is, the base body constituted by the magnetic sheets and the coil sandwiched between the magnetic sheets) is then plated and thereby given outer electrodes. The outer electrodes are formed by: placing a mask on the surface of the base body except for the areas in which the outer electrodes are to be formed; and then pre-treating the base body with a conductive liquid and plating the base body. During this process, if the base body has a groove, a space results between the mask and the base body and the conductive liquid enters the space. As a result, the plating layer forms not only in the predetermined areas but also in other areas. If the plating layer forms in such other areas, the two outer electrodes may short-circuit. This is not preferred.

SUMMARY

Accordingly, it is an object of the present disclosure to provide a coil component which is produced by a sheet press method and which does not experience undesired spreading of plating during a plating process even when the coil component has a groove.

The inventor of the present disclosure has studied hard to attain the above object and found that when a silicone mold release agent, which is a silicone resin for easy release of metal sheets from a mold after press molding, is caused to exist in a groove in side faces of the coil component, a conductive liquid for pretreatment and a plating solution are suppressed from entering the groove.

According to a preferred embodiment of the present disclosure, there is provided a coil component including: a magnetic body containing a magnetic material and a resin; a coil buried in the magnetic body; and a pair of outer electrodes electrically connected to the coil. One or more side faces of the magnetic body have a groove, and the groove contains a silicone resin.

According to another preferred embodiment of the present disclosure, there is provided a method for producing a coil component that includes: a magnetic body containing a magnetic material and a resin; a coil buried in the magnetic body; and a pair of outer electrodes electrically connected to the coil. The method includes: applying a silicone resin to a mold and/or a coil; placing the coil in the mold, placing a magnetic sheet over the coil, and performing primary press molding to mold the magnetic sheet; and placing another magnetic sheet on a face of the molded magnetic sheet and performing secondary press molding, the face being a face on which the coil is exposed.

Other features, elements, characteristics, and advantages of the present disclosure will become more apparent from the following detailed description of preferred embodiments of the present disclosure with reference to the attached drawings.

DETAILED DESCRIPTION OF THE DRAWINGS

Figure 1:
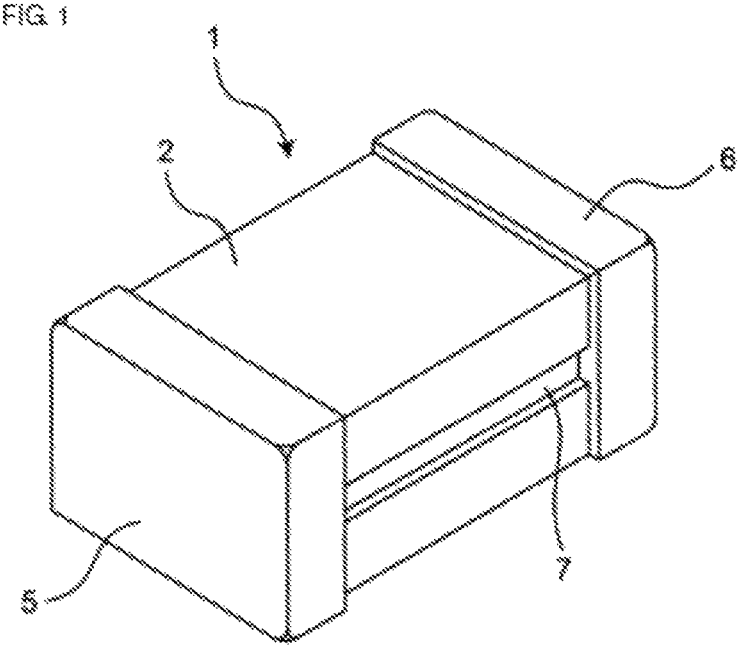
FIG. 1 is a perspective view schematically showing a coil component of one embodiment of the present disclosure.

The following specifically describes a coil component of the present disclosure with reference to the drawings. It should be noted, however, that the shapes, relative positions, and the like of the constituents of the coil component of the present embodiment are not limited to those illustrated in the drawings.

Figure 2:
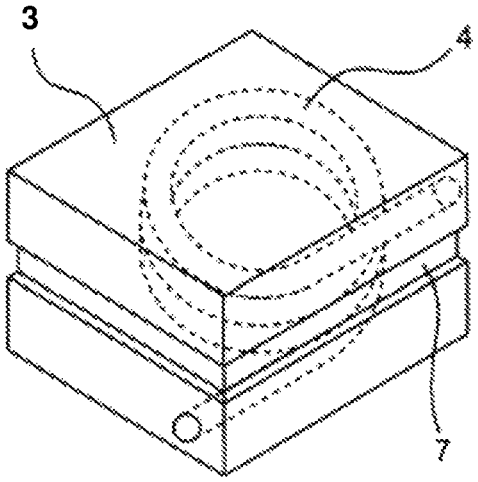
FIG. 2 is a transparent perspective view schematically showing a base body of the coil component shown in FIG. 1.

FIG. 1 is a perspective view schematically showing a coil component 1 of the present embodiment, and FIG. 2 is a transparent perspective view schematically showing a base body 2 of the coil component.

As shown in FIGS. 1 and 2, the coil component 1 of the present embodiment is substantially in the shape of a cuboid. As is shown schematically, the coil component 1 includes: a base body 2 constituted by a magnetic body 3 and a coil 4 buried in the magnetic body 3; and outer electrodes 5 and 6 disposed on the opposite side faces of the base body 2. One end of the coil 4 is electrically connected to the outer electrode 5, and the other end is electrically connected to the outer electrode 6. The base body 2 has a groove 7 in its side faces. In the groove 7, there exists a silicone resin.

The coil component 1 may be produced by, for example, a method including: applying a silicone resin to a mold and/or a coil; placing the coil in the mold, placing a magnetic sheet over the coil, and performing primary press molding to mold the magnetic sheet; and placing another magnetic sheet on a face of the molded magnetic sheet on which the coil is exposed and performing secondary press molding. Specifically, the coil component 1 may be produced in the following manner.

First, coils are placed in a mold.

When the coils are placed in the mold, a silicone resin is applied to the mold and/or the coils.

The silicone resin denotes a resin formed from siloxane bonds with any of various groups such as organic groups (e.g., alkyl groups) in side chains. The silicone resin may be a modified silicone, such as an amino-modified silicone, an alcohol-modified silicone, a vinyl-modified silicone, an amide-modified silicone, or the like.

The silicone resin for use in the present disclosure is not limited to a particular kind, provided that the silicone resin is generally for use as a mold release agent. Examples of the mold release agent include: KF96SP, KF412SP, and KM722 available from Shin-Etsu Chemical Co., Ltd.; and Frelease 70 and Frelease 480 available from NEOS COMPANY LIMITED.

The amount of the silicone resin applied to the mold or the coils may be, for example, about 1.0 $g/m^2$ or more and 15 $g/m^2$ or less, preferably about 1.5 $g/m^2$ or more and 12 $g/m^2$ or less, more preferably about 1.5 $g/m^2$ or more and 10 $g/m^2$ or less. The amount may be, for example, about 1.5 $g/m^2$ or more and 5.0 $g/m^2$ or less.

The total amount of the silicone resin applied to the mold and the coils is preferably about 15 $g/m^2$ or less, more preferably about 12 $g/m^2$ or less.

According to an aspect, when the amount of the silicone resin applied to the mold is about 12 $g/m^2$ or more, the amount of the silicone resin applied to the coils is preferably about 3.0 $g/m^2$ or less, more preferably about 1.5 $g/m^2$ or less.

According to another aspect, when the amount of the silicone resin applied to the mold is about 3.0 $g/m^2$ or more and less than about 12 $g/m^2$, the amount of the silicone resin applied to the coils is preferably about 12 $g/m^2$ or less, more preferably about 5.0 $g/m^2$ or less, even more preferably about 3.0 $g/m^2$ or less.

The method of applying the silicone resin is not particularly limited and may be, for example, spray application, brush application, dipping, or the like.

According to an aspect, the mold has projections/depressions on its surface. By adjusting the positions, sizes, and/or shapes of the projections/depressions on the mold, it is possible to adjust the distribution of the pressure applied on the magnetic sheets during pressing. By adjusting the pressure distribution, it is possible to make grooves in the intended faces of the coil components.

The coils for use in the present disclosure are not particularly limited, provided that the coils are generally for use in coil components.

The material for the coils is not particularly limited, provided that the material is a conductive material. Examples of the material include copper, silver, nickel, and the like. Copper is preferred.

According to an aspect, each coil may be a covered conductor covered with an insulating material such as a polyurethane resin or a polyester resin.

The number of coil turns, coil diameter, wire diameter, and the like are not particularly limited and may be determined as appropriate according to the purpose of use.

Next, a magnetic sheet is placed over the coils and thereafter primary press molding is performed. The primary press molding causes at least a part of each coil to be buried into the magnetic sheet and the space inside the coil to be filled with the magnetic sheet.

The magnetic sheet contains a magnetic material and a resin.

The magnetic material is not particularly limited and may be, for example, a magnetic metal material, a ferrite material, or the like.

The magnetic metal material is not particularly limited and may be, for example, iron, cobalt, nickel, or gadolinium, or an alloy containing one or more such metals.

The ferrite material is not particularly limited and may be, for example, a Ni—Zn—Cu ferrite, a Ni—Cu ferrite, a Ni—Zn ferrite, a Mn—Zn ferrite, or the like.

The magnetic material is contained in an amount of preferably about 50 vol % or more, more preferably about 60 vol % or more, even more preferably about 70 vol % or more, with respect to the entire magnetic sheet. The magnetic sheet containing about 50 vol % or more, particularly about 60 vol % or more of the magnetic material improves the magnetic characteristics of the coil component of the present disclosure. The magnetic material is contained in an amount of preferably about 95 vol % or less, more preferably about 90 vol % or less, even more preferably about 87 vol % or less, further preferably about 85 vol % or less, with respect to the entire magnetic sheet. When the amount of the magnetic material is about 95 vol % or less, particularly about 85 vol % or less, it is easy to ensure the insulating property of the magnetic sheet.

According to an aspect, the magnetic material is in the form of particles. The particles of the magnetic material may be coated with an insulating material.

The resin is not particularly limited and may be, for example, an epoxy resin, a phenol resin, a polyester resin, a polyimide resin, a polyolefin resin, or the like.

The magnetic sheet may be obtained by dispersing the magnetic material into the resin and forming the obtained resin into a sheet.

The thickness of the magnetic sheet may be selected as appropriate according to the size of the coil component to be produced. The thickness may be, for example, about 50 μm or more and 2 mm or less, about 100 μm or more and 1 mm or less, about 200 μm or more and 500 μm or less.

The pressure at which the press molding is performed is selected as appropriate according to the type of the magnetic sheet, and may be, for example, about 0.1 MPa or more and 30 MPa or less, preferably about 1 MPa or more and 10 MPa or less.

The temperature at which the press molding is performed is selected as appropriate according to the type of the magnetic sheet, and may be, for example, about 100° C. or higher and 250° C. or lower, preferably about 100° C. or higher and 200° C. or lower.

The time over which the press molding is performed is selected as appropriate according to the type of the magnetic sheet, and may be, for example, about 10 minutes or longer and 60 minutes or shorter, preferably about 20 minutes or longer and 30 minutes or shorter.

Next, the magnetic sheet in which the coils are buried, obtained by the primary press molding, is released from the mold. Then, another magnetic sheet is placed on the surface of the molded magnetic sheet on which the coils are exposed, and secondary press molding is performed. In this way, a collective coil substrate including a plurality of base bodies is obtained.

The two magnetic sheets are joined together by the secondary press molding to form a magnetic body of each coil component.

The another magnetic sheet may be the same as or different from the first-mentioned magnetic sheet. Both magnetic sheets are preferably the same magnetic sheets.

The pressure, temperature, and time for the secondary press molding may be the same as those for the primary press molding.

Next, the collective coil substrate obtained by the secondary press molding is divided into single base bodies. On the opposite side faces of each base body, the respective opposite ends of the coil are exposed. It should be noted that a side face denotes a face that has the boundary between the two magnetic sheets. In the present embodiment, the side faces are cut surfaces resulting from the division of the collective coil substrate.

The collective coil substrate may be divided into single base bodies with the use of a dicing blade, any of various laser devices, a dicer, any of various knives, or a mold.

According to a preferred aspect, the cut surfaces of each base body are barrel-finished.

Next, the side faces on which the respective ends of the coil are exposed are given outer electrodes. The ends of the coil are electrically connected to the respective outer electrodes.

The material for the outer electrodes is not particularly limited and may be, for example, a metal such as Au, Pb, Pd, Ag, Sn, Ni, or Cu, or an alloy containing any of such metals.

The method of forming the outer electrodes is not particularly limited and may be, for example, electrolytic plating, nonelectrolytic plating, vapor deposition, sputtering, baking of a conductive paste, or the like. The method may be preferably plating such as electrolytic plating or nonelectrolytic plating.

The areas on the base body in which the outer electrodes are to be formed may be preferably pre-treated with a conductive liquid before the plating process.

The coil component 1 thus obtained has a groove 7 in the side faces of the base body 2 (magnetic body 3).

The groove 7 has therein the silicone resin, which has seeped out of the base body during press molding. The silicone resin may exist not only in the groove but also in the area around the groove.

According to a preferred aspect, the surface layer of the faces, which have the groove, of the magnetic body of the coil component of the present disclosure contains the silicone resin in an amount of about 0.3 mass % or more and 12 mass % or less, preferably about 0.5 mass % or more and 10 mass % or less, with respect to the entire constituents of the surface layer of the magnetic body. When the amount of the silicone resin is about 0.3 mass % or more, particularly about 0.5 mass % or more, spreading of plating is suppressed to a greater extent. Furthermore, when the amount of the silicone resin is about 12 mass % or less, particularly about 10 mass % or less, poor adhesion of plating is suppressed.

The amount of the silicone contained in the surface layer of the magnetic body can be determined by performing an energy dispersive X-ray spectrometry (EDX analysis) on a face, which has a groove, of the magnetic body with the use of an SU-1510/EMAX Evolution available from Hitachi High-Technologies Corporation (accelerating voltage 15 kV, emission current 80 μA, WD 15 mm, movable objective diaphragm 3, measuring time 60 sec). Specifically, the analysis is performed on a magnetic body obtained by applying the silicone resin and on a magnetic body obtained by applying no silicone resin (this magnetic body is a standard sample), and the ratio of Si to Fe+C (the amount of Fe+C is defined as 100) in each magnetic body is calculated from the results of the analysis. The ratio of Si in the surface layer of the magnetic body obtained by applying no silicone resin is subtracted from the ratio of Si in the surface layer of the magnetic body obtained by applying the silicone resin, thereby finding the ratio of Si derived from the silicone resin. Furthermore, for the purpose of verifying that the detected Si is derived from the silicone resin, the substances detectable on the surface of the magnetic body are analyzed with the use of a Fourier transform-infrared spectrometer (FT-IR) to confirm the presence of siloxane bonds.

As used herein, the surface layer of the magnetic body denotes a region extending from the surface to a depth of about 10 μm of the magnetic body.

The foregoing description discussed a coil component 1 and a method for producing the coil component 1 of the present embodiment. It should be noted, however, that a coil component and a method for producing a coil component of the present disclosure are not limited to the present embodiment and may be modified in various ways.

For example, although the center axis of the coil of the coil component 1 is perpendicular to the main faces of the magnetic sheets in the present embodiment, the center axis may be parallel to the main faces of the magnetic sheets.

Furthermore, although the space inside the coil of the coil component 1 is filled with the magnetic sheet during press molding in the present embodiment, the coil may originally have a core in the space thereof. For example, a coil obtained by wrapping any of various conductive wires around a core may be used.

Although the secondary press molding is performed after the primary press molding in the present embodiment, press molding may be performed only once after placing coils on a magnetic sheet and then pacing another magnetic sheet over the coils.

Although all of the four side faces of the base body have a groove in the present embodiment, the groove may exist only in three or less of the four side faces. For example, only one side face, two side faces, or three side faces may have a groove.

EXAMPLES

Example 1

Metal magnetic sheets containing metal magnetic powder and a resin were prepared. Furthermore, a mold that has projections/depressions so as to reduce the pressure applied on the portions corresponding to grooves in coil components was prepared.

Next, a silicone resin was uniformly sprayed to coils in the amount shown in Table 1 and thereafter the solvent was evaporated to dryness.

Next, the coils with the silicone resin were placed in the mold, one of the metal magnetic sheets was placed over the coils, and the coils and the sheet were pressed with a pressure of about 5 MPa at about 150° C. for about 30 minutes. In this way, the spaces inside the coils were filled with the metal magnetic sheet.

Next, the metal magnetic sheet molded together with the coils was removed from the mold. The other one of the metal magnetic sheets was placed on the surface of the molded metal magnetic sheet on which the coils were exposed, and pressed with a pressure of about 5 MPa at about 150° C. for about 30 minutes. In this way, a collective coil substrate that has the coils buried therein was prepared. Next, the collective coil substrate was divided with the use of a dicing blade into single base bodies and subjected to barrel finishing. Each base body thus obtained had a continuous groove around the side faces. It should be noted that the groove was partially discontinuous in two faces on which respective outer electrodes are to be formed.

Next, the side faces of the obtained base body on which the outer electrodes are to be formed were pre-treated with a conductive liquid containing palladium and thereafter plated with Cu, such that the outer electrodes were formed. In this way, the coil components were prepared.

Comparative Example

A coil component of Comparative Example 1 was prepared in the same manner as in Example 1, except that no silicone resin was applied to the coil.

Evaluation

The amount of silicone contained in the surface layer of the faces each having the groove connecting the two outer electrodes of each coil component obtained as described above was determined by the earlier-mentioned EDX analysis. The results are all shown in Table 1.

Furthermore, ten coil components of each of Examples and Comparative Example were visually checked for poor adhesion of plating and spreading of plating. The number of samples which had poor adhesion of plating and the number of samples which had spreading of plating are also shown in Table 1.

TABLE 1

| | Amount of applied silicone resin ($g/m^2$) | Amount of silicone resin contained (mass %) | Number of defective samples | |
|---|---|---|---|---|
| | | | poor adhesion of plating | spreading of plating |
| Example 1-1 | 1.5 | 0.3 | 0/10 | 3/10 |
| Example 1-2 | 3.0 | 1.8 | 0/10 | 0/10 |
| Example 1-3 | 12.0 | 5.3 | 0/10 | 0/10 |
| Comparative Example 1 | 0 | 0 | 0/10 | 8/10 |

As shown in Table 1, it was confirmed that, when a silicone resin is applied to the coil, the surface layer of the resulting coil component contains the silicone resin. This reduced the defects due to spreading of plating. In particular, when the silicone resin in an amount of about 3.0 $g/m^2$ or more was applied, the defects due to spreading of plating were prevented.

Example 2

Coil components of Example 2 were prepared in the same manner as in Example 1, except that the silicone resin was applied also to the mold as well as the coil. The silicone resin was applied to the coil and the mold in the amounts shown in Table 2.

TABLE 2

| | | Amount of silicone resin applied to coil ($g/m^2$) | | | |
|---|---|---|---|---|---|
| | | none | 1.5 | 3.0 | 12.0 |
| Amount of silicone resin applied to mold | 1.5 | Example 2-1 | Example 2-2 | Example 2-3 | Example 2-4 |
| | 3.0 | Example 2-5 | Example 2-6 | Example 2-7 | Example 2-8 |
| | 12.0 | Example 2-9 | Example 2-10 | — | — |

Evaluation

The amount of the silicone resin contained in the surface layer of the coil component of each Example was determined and poor adhesion of plating and spreading of plating were visually checked in the same manner as in Example 1. The results are shown in Table 3.

TABLE 3

| | Amount of silicone resin contained (mass %) | Number of defective samples | |
|---|---|---|---|
| | | poor adhesion of plating | spreading of plating |
| Example 2-1 | 0.5 | 0/10 | 0/10 |
| Example 2-2 | 2.3 | 0/10 | 0/10 |
| Example 2-3 | 4.2 | 0/10 | 0/10 |
| Example 2-4 | 7.8 | 0/10 | 0/10 |
| Example 2-5 | 4.5 | 0/10 | 0/10 |
| Example 2-6 | 7.2 | 0/10 | 0/10 |
| Example 2-7 | 8.3 | 0/10 | 0/10 |
| Example 2-8 | 11.9 | 3/10 | 0/10 |
| Example 2-9 | 10.0 | 0/10 | 0/10 |
| Example 2-10 | 11.8 | 4/10 | 0/10 |

As shown in Table 3, it was confirmed that, when a silicone resin is applied to the coil and the mold, the surface layer of the resulting coil component contains the silicone resin. This prevented the defects due to spreading of plating. In particular, when the silicone resin in an amount of about 10.0 $g/m^2$ or less was contained in the surface layer, the defects due to poor adhesion of plating were also prevented.

A coil component of the present disclosure may be widely used as an inductor or the like in various applications.

According to preferred embodiments of the present disclosure, a coil component which includes: a magnetic body containing a magnetic material and a resin; a coil buried in the magnetic body; and a pair of outer electrodes electrically connected to the coil is structured such that one or more side faces of the magnetic body have a groove and the groove contains a silicone resin. This makes it possible to provide a coil component that experiences few plating failures such as spreading of plating.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A method for producing a coil component that includes:

a magnetic body containing a magnetic material and a resin;

a coil buried in the magnetic body; and a pair of outer electrodes electrically connected to the coil, the method comprising:

applying a silicone resin to at least one selected from the group consisting of a mold and a coil;

placing the coil in the mold, placing a magnetic sheet over the coil, and performing primary press molding to mold the magnetic sheet; and placing another magnetic sheet on a face of the molded magnetic sheet and performing secondary press molding, the face being a face on which the coil is exposed.

* * * * *